US009436118B2

(12) United States Patent
Fukuda

(10) Patent No.: US 9,436,118 B2
(45) Date of Patent: Sep. 6, 2016

(54) IMAGE FORMING APPARATUS FOR FORMING AN IMAGE TO CHANGE THE POTENTIAL OF A PHOTOCONDUCTOR

(71) Applicant: CANON KABUSHIKI KAISHA, Tokyo (JP)

(72) Inventor: Tadashi Fukuda, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/559,106

(22) Filed: Dec. 3, 2014

(65) Prior Publication Data

US 2015/0160578 A1 Jun. 11, 2015

(30) Foreign Application Priority Data

Dec. 5, 2013 (WO) ..... PCT/JP2013/082665

(51) Int. Cl.
*G03G 15/06* (2006.01)
*G03G 15/02* (2006.01)

(52) U.S. Cl.
CPC ..... *G03G 15/0291* (2013.01); *G03G 15/065* (2013.01)

(58) Field of Classification Search
CPC ..... G03G 15/0291; G03G 15/065
USPC ..... 399/55, 170–173
See application file for complete search history.

(56) References Cited

U.S. PATENT DOCUMENTS

2010/0322665 A1* 12/2010 Oki ..... G03G 15/0291 399/115

FOREIGN PATENT DOCUMENTS

| | | | |
|---|---|---|---|
| JP | 6-83160 | A | 3/1994 |
| JP | 06-102740 | A | 4/1994 |
| JP | 2002-23436 | A | 1/2002 |
| JP | 2006-313277 | A | 11/2006 |
| JP | 2009-31768 | A | 2/2009 |
| JP | 2010-281938 | A | 12/2010 |
| JP | 2011-22568 | A | 2/2011 |

* cited by examiner

*Primary Examiner* — Walter L Lindsay, Jr.
*Assistant Examiner* — Ruth Labombard
(74) *Attorney, Agent, or Firm* — Canon U.S.A. Inc., IP Division

(57) ABSTRACT

A first mode in which a toner image is formed on a surface of a photoconductor by forming an electrostatic latent image with exposure means and a second mode in which a toner image used to adjust a tilt of a corona charger relative to the surface of the photoconductor in a longitudinal direction of the corona charger is output substantially without forming an electrostatic latent image with the exposure means are executable. An oscillating voltage superimposed in a developing bias in the second mode is set such that an amount of change in density of the toner image relative to an amount of change in developing contrast within a predetermined range of the density of the toner image becomes larger for the developing bias used in the second mode than for the developing bias used in the first mode.

4 Claims, 10 Drawing Sheets

IMAGE FORMING APPARATUS FOR FORMING AN IMAGE TO CHANGE THE POTENTIAL OF A PHOTOCONDUCTOR

TECHNICAL FIELD

The present invention relates to image forming apparatuses utilizing an electrophotographic process, such as a copier, a printer, a facsimile machine, and a multifunction device having a plurality of functions of these devices.

BACKGROUND ART

In an image forming apparatus, such as a copier, that performs image formation by developing, with toner, an electrostatic latent image that has been formed on a photoconductor to form a toner image and by transferring the toner image onto paper serving as a recording medium, the surface potential of the photoconductor in the main-scanning direction may become uneven because of variations in distance between a corona charger and the photoconductor in the main-scanning direction of the photoconductor (a tilt of the corona charger). Consequently, for example, fog of toner may appear at a portion of the photoconductor in the main-scanning direction.

Conventionally, in order to resolve the problem described above, an analog image forming apparatus is caused to copy a white reference original, and an adjustment toner image is formed on a recording medium on the basis of an electrostatic latent image formed through radiation based on an image of the original performed at that time according to PTL 1, for example. PTL 1 also discloses that a tilt of a corona charger relative to a photoconductor is adjusted on the basis of a density of this adjustment toner image.

However, PTL 1 describes an analog development (normal development) method, and thus the adjustment toner image is formed in a region corresponding to an exposed portion which is a bright portion exposed to light by an exposure means.

Thus, the density of the toner image on the recording medium varies due to the influence of variations in an amount of exposure given by the exposure means. If the amount of exposure given by the exposure means is uneven, it is difficult to accurately measure an amount of variations in density caused by a tilt of the corona charger, and consequently highly accurate tilt adjustment cannot be performed.

PTL 2 has proposed a technique for forming an adjustment toner image used to adjust a tilt of a corona charger by attaching toner onto a dark portion potential on the surface of a photoconductor without performing exposure by an exposure means, in order to suppress a decrease in accuracy in adjustment of a tilt of the corona charger due to variations in an amount of exposure given by the exposure means in an image forming apparatus that adjusts a tilt of the corona charger by using a toner image output on a recording medium.

CITATION LIST

Patent Literature

PTL 1: Japanese Patent Laid-Open No. 06-102740

PTL 2: Japanese Patent Laid-Open No. 2009-31768

However, in PTL 2, the adjustment toner image used to adjust a tilt of the corona charger is formed using a developing bias having the same waveform as a developing bias applied to a developing means during normal image formation in which a toner image is formed by developing an electrostatic latent image formed on a photoconductor as a result of exposure by the exposure means, and the adjustment toner image is transferred onto a recording medium and is output. However, in the adjustment toner image used to adjust a tilt of the corona charger that has been formed on the recording medium by using the developing bias having the same waveform as the developing bias applied to the developing means during normal image formation as in PTL 2, an amount of change in density corresponding to a slight change in the surface potential of the photoconductor caused by the tilt of the corona charger is very small, and thus it is difficult to visually recognize this change in density. Accordingly, there is a problem in that a tilt of the corona charger cannot be recognized and the tilt of the corona charger cannot be accurately adjusted.

Accordingly, it is an object of the present invention to provide an image forming apparatus that enables, by forming a toner image used to adjust a tilt of a corona charger so that a change in surface potential of a photoconductor is emphasized as a change in density, a slight change in surface potential of the photoconductor to be visually recognized as a change in density of the toner image.

SUMMARY OF INVENTION

Accordingly, an image forming apparatus according to the present invention includes a photoconductor; a corona charger disposed to oppose a surface of the photoconductor and configured to charge the surface of the photoconductor; exposure means configured to expose the surface of the photoconductor that has been charged by the corona charger to light so as to form an electrostatic latent image on the surface of the photoconductor; developing means configured to develop, with toner, the electrostatic latent image that has been formed by the exposure means so as to form a toner image on the surface of the photoconductor; developing bias application means configured to apply a developing bias obtained by superimposing a DC voltage and an oscillating voltage to the developing means; transfer means configured to transfer the toner image that has been formed on the photoconductor onto a recording medium; and execution means configured to execute a first mode and a second mode, the first mode being a mode in which an electrostatic latent image is formed by the exposure means on the surface of the photoconductor that has been charged by the corona charger and a toner image that has been formed on the surface of the photoconductor by the developing means is transferred onto a recording medium and is output, the second mode being a mode in which a toner image that has been formed on the surface of the photoconductor by the developing means substantially without forming, by the exposure means, an electrostatic latent image on the surface of the photoconductor that has been charged by the corona charger is transferred onto a recording medium and is output as a toner image used to adjust a tilt of the corona charger relative to the surface of the photoconductor in a longitudinal direction of the corona charger, wherein the execution means sets the oscillating voltage of the developing bias used in the second mode such that an amount of change in density of the toner image relative to an amount of change in developing contrast within a predetermined range of the density of the toner image becomes larger for the developing bias used in the second mode than for the developing bias used in the first mode, the developing contrast being a potential difference between a value of the DC voltage of the developing bias and a potential at a region on the surface of the photoconductor in which the toner image is formed, and sets the developing contrast used in the second mode such that the density of the toner image is within the predetermined range.

Further features of the present invention will become apparent from the following description of exemplary embodiments with reference to the attached drawings.

DESCRIPTION OF EMBODIMENTS

Embodiments of the present invention will be described in detail below with reference to the drawings. Note that components denoted by the same reference throughout the drawings are those having the same configuration or performing the same operation, and a duplicated description regarding these components is appropriately omitted. Note that the sizes, materials, shapes of components, relative positions of the components, etc. do not intend to limit an applicable range of this technical spirit only to those unless otherwise specially noted.

First Exemplary Embodiment

After a general configuration of an image forming apparatus is briefly described first, a charging device (corona charger) according to the present exemplary embodiment will be described in detail.

Figure 1:
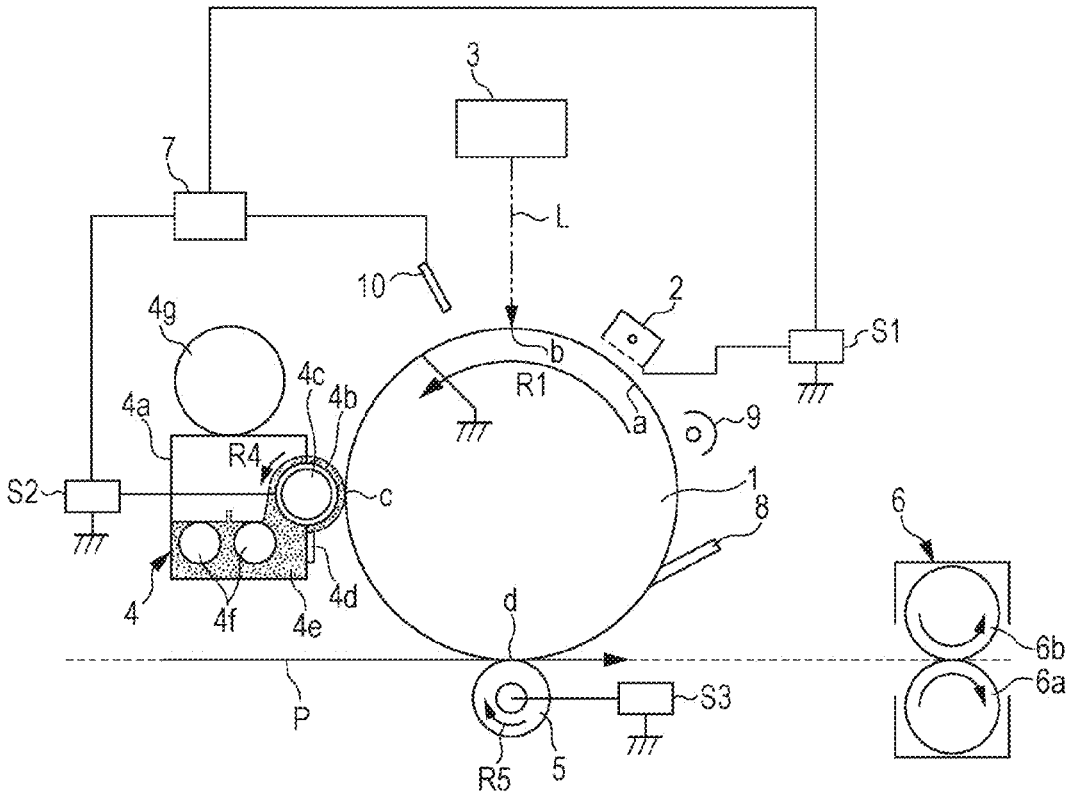
FIG. 1 is a configuration diagram schematically illustrating an example of an image forming apparatus according to the present exemplary embodiment.

FIG. 1 illustrates an image forming apparatus according to the present exemplary embodiment. The image forming apparatus illustrated in this figure is a laser beam printer (hereinafter, referred to as an "image forming apparatus") in which the maximum paper size of a recording medium (e.g., paper) is 19-inch long and 13-inch wide. Also, the image forming apparatus according to the present exemplary embodiment is of the electrophotographic type and employs, as its exposure method, an image area exposure method in which an image portion to be attached with toner through development is exposed to light. The image forming apparatus also employs a corona charging method as its charging method and a reversal development method as its development method.

[Overall Configuration of Image Forming Apparatus]

As illustrated in FIG. 1, the image forming apparatus according to the present exemplary embodiment includes a photoconductor drum (image bearing member) 1 which serves as a photoconductor. In the vicinity of this photoconductor drum 1, a corona charger 2, an exposure device (exposure means) 3, a potential measuring device 10, a developing device (developing means) 4, a transfer roller (transfer means) 5, a cleaning blade 8, and a discharging device 9 are arranged along a direction in which the photoconductor drum rotates (along a direction of arrow R1). Also, a fixing device (fixing means) 6 is arranged downstream of the transfer roller 5 along a direction in which a recording medium P is transported.

[1] Photoconductor Drum (Image Bearing Member)

The image forming apparatus according to the present exemplary embodiment includes a photoconductor drum 1 (rotational drum-type electrophotographic photoconductor) as a photoconductor. This photoconductor drum 1 includes a photosensitive layer formed of an OPC (organic optical semiconductor) having a negative charge characteristic. The photoconductor drum 1 is formed to have a diameter of 84 mm, and is rotationally driven in the direction of arrow R1 at a process speed (peripheral speed) of 300 mm/sec about a central shaft (not illustrated).

Figure 2:
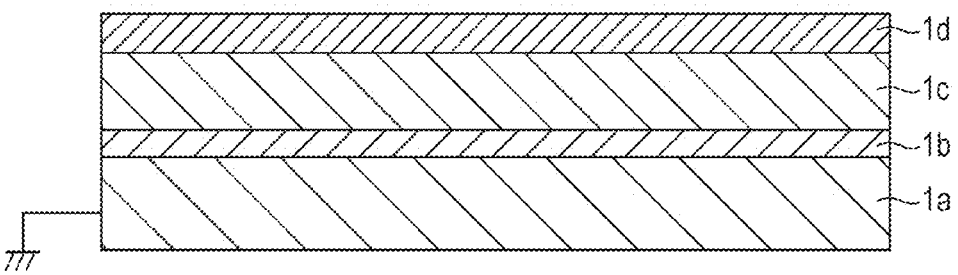
FIG. 2 is a sectional view schematically illustrating a layered structure of a photoconductor drum.

FIG. 2 schematically illustrates a layered structure of the photoconductor drum 1. As illustrated in this figure, the photoconductor drum 1 includes a conductive drum base (conductive base: e.g., aluminum cylinder) la at the inner side thereof (lower side in the figure). On the surface of the conductive drum base 1*a*, three layers, i.e., an undercoat layer 1*b* which suppresses interference of light and improves adhesiveness of the upper layers, a charge generation layer 1*c*, and a charge transporting layer 1*d*, are stacked sequentially from the inner side. Among these layers, the charge generation layer 1*c* and the charge transporting layer 1*d* form the photosensitive layer.

[2] Corona Charger

The image forming apparatus illustrated in FIG. 1 includes the corona charger 2 as a charging means. The corona charger 2 which serves as the charging means according to the present exemplary embodiment is a scorotron-type discharging device which includes a wire, a conductive shield, and a grid electrode. The wire serves as a discharge electrode that is extended in a tensioned state along the longitudinal direction of the corona charger to be located separate from the surface of the photoconductor drum 1 by a predetermined distance. The conductive shield includes openings between the photoconductor drum and a wire provided to surround the wire. The grid electrode serves as a grid provided at the openings. The corona charger 2 also performs a process for evenly charging the surface (perimeter surface) of the photoconductor drum 1 to have a certain polarity/potential as a result of a voltage which is a charging bias being applied to the discharge electrode and the grid electrode by a charging-bias application power source S1 which serves as a charging bias application means. A control means 7 controls power to be supplied to the charging means so that a charge potential (dark portion potential) becomes −700 V during image formation. In the present exemplary embodiment, the control means 7 performs constant current control to make a value of current that flows through the corona discharge electrode equal to −1000 μA and controls a DC voltage applied to the grid, thereby adjusting the charge potential. Note that, the corona charger according to the present exemplary embodiment is capable of adjusting its tilt relative to the surface of the photoconductor drum 1 in the longitudinal direction of the corona charger by using a charger tilt adjusting means described later.

[3] Exposure Device (Exposure Means)

The image forming apparatus illustrated in FIG. 1 includes the exposure device 3 as an exposure means for forming an electrostatic latent image by exposing the surface of the photoconductor drum 1, which has been subjected to the charging process by the corona charger 2, to light. In the present exemplary embodiment, the exposure device 3 is a laser beam scanner that employs a semiconductor laser, and exposes the surface of the photoconductor drum 1 to light at an exposure position a that opposes the exposure device 3. The exposure device 3 outputs a laser beam L modulated in accordance with an image signal sent from a host process of an image scanner (not illustrated) or the like to the image forming apparatus body side. The surface of the rotating photoconductor drum 1 which has been subjected to the charging process is scanned and exposed with this laser beam L (image exposure) at an exposure position b. Through this scanning and exposure, potential at a portion irradiated with the laser beam L lowers (−300 V in the present exemplary embodiment) among the charged surface of the surface of the photoconductor drum 1, and an electrostatic latent image based on image information is formed.

[4] Developing Device (Developing Means)

The developing device (developer) 4 which serves as a developing means supplies a developing agent (toner) to the electrostatic latent image (exposed portion) on the photoconductor drum 1 so as to cause the toner to attach to a region of the bright portion, thereby visualizing the electrostatic latent image into a toner image. In the present embodiment, the developing device 4 is a developing device configured to perform reversal development based on the two-component magnetic brush development method.

The developing device 4 includes a developing container 4*a*, a developing sleeve 4*b*, a magnetic roller 4*c*, a developing-agent coating blade 4*d*, developing-agent stirring members 4*f*, and a toner hopper 4*g*. Also, a reference sign 4*e* illustrated in FIG. 1 represents a two-component developing agent contained in the developing container 4*a*.

The developing container 4*a* contains the two-component developing agent 4*e* and supports the developing sleeve 4*b* and the like to allow the developing sleeve 4*b* and the like to rotate. The developing sleeve 4*b* is a non-magnetic cylindrical member, and is arranged in the developing container 4*a* to be able to rotate, with part of its perimeter surface exposed to outside. The magnetic roller 4*c* is inserted inside the developing sleeve 4*b* with being fixed not to rotate. The developing-agent coating blade 4*d* regulates thickness of a layer of the two-component developing agent 4*e* that coats the surface of the developing sleeve. The developing-agent stirring members 4*f* are provided at a bottom part within the developing container 4*a*, stir the two-component developing agent 4*e*, and transport the two-component developing agent 4*e* to the developing sleeve 4*b*. The toner hopper 4*g* is a container that contains additional toner to be supplied to the developing container 4*a*.

The two-component developing agent 4*e* contained in the developing container 4*a* is a mixture of toner and magnetic carrier, and is stirred by the developing-agent stirring members 4*f*. In the present embodiment, the magnetic carrier has a resistance of about 1013 Ω·cm and has a particle diameter of 40 μm. The toner rubs against the magnetic carrier, and is negatively charged by rubbing.

The above-described developing sleeve 4*b* is arranged to closely oppose the photoconductor drum 1 with its smallest proximity distance (S−Dgap) to the photoconductor drum 1 kept at 350 p.m. This portion at which the photoconductor drum 1 and the developing sleeve 4*a* oppose each other serves as a development portion c. The developing sleeve 4*b* is rotationally driven so that its surface moves in a direction opposite to the moving direction of the surface of the photoconductor drum 1 at the development portion c. That is, relative to rotation of the photoconductor drum 1 in the direction of arrow R1, the developing sleeve 4*b* is rotationally driven in a direction of arrow R4.

Part of the two-component developing agent 4*e* contained in the developing container 4*a* is adsorbed and held, as a magnetic brush layer, on the perimeter surface of this developing sleeve 4*b* by a magnetic force of the magnetic roller 4*c* located inside the developing sleeve 4*b*, and is rotationally transported as the developing sleeve 4*b* rotates. The magnetic brush layer is adjusted into a thin layer of a predetermined thickness by the developing-agent coating blade 4*d*, and comes into contact with the surface of the photoconductor drum 1 at the development portion c and rubs against the surface of the photoconductor drum appropriately.

A developing bias applied to the developing sleeve 4*b* is applied by an application power source S2 which serves as a developing bias application means, and is controlled by the control means 7. In the present exemplary embodiment, a voltage obtained by superimposing a DC voltage and an oscillating voltage is used as the developing bias. A charge potential of the photoconductor drum 1 that has been charged by the corona charger 2 is detected by the potential measuring means 10, and the control means 7 which serves as an execution means is configured to receive information based on the detection result. When executing an analog image output mode which is a second mode described later, the control means 7 controls the developing bias on the basis of the detection result input from the potential measuring means 10 so that a not-exposed portion which is a dark portion is attached with toner and is developed.

In the above-described developing device 4, the developing agent contained in the developing container 4*a* coats the surface of the rotating developing sleeve 4*b* as a thin layer and is transported to the development portion c. Here, the toner included in the developing agent selectively attaches to the electrostatic latent image on the photoconductor drum 1 by an electric field caused by the developing bias applied to the developing sleeve 4*b* by the developing-bias application power source S2. In the present exemplary embodiment, during normal image formation which is a first mode in which an electrostatic latent image is formed on the photoconductor by the exposure device 3 to form a toner image, the DC voltage component Vdc of the developing bias is set to −550 V and the oscillating voltage component thereof is set as a blank pulse having a peak-to-peak voltage of 1.25 Vpp so as to have a frequency of 12 kHz during oscillation periods.

Figure 10A:
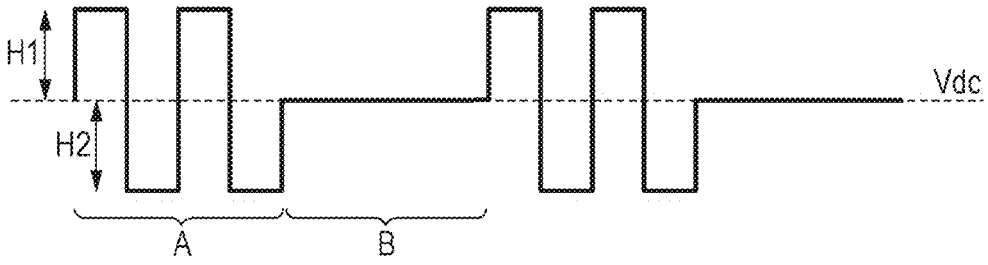
FIGS. 10A to 10C are diagrams illustrating an example of waveforms of a developing bias.
Figure 10B:
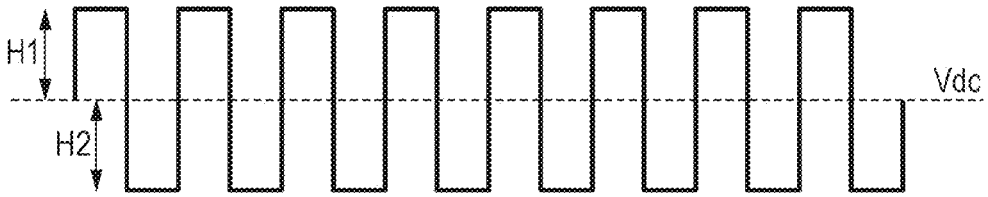
Figure 10C:
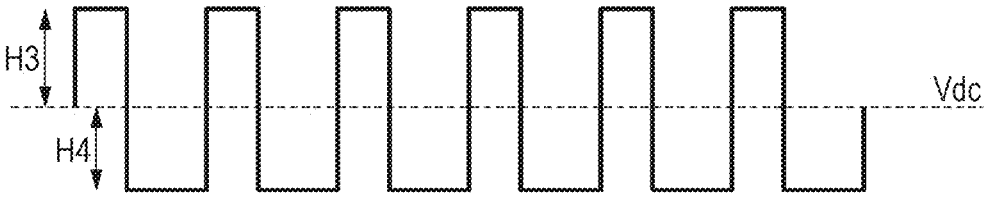

Now, a blank pulse will be described in detail. FIGS. 10A to 10C are schematic diagrams of waveforms of the developing bias such as a blank pulse. As in FIG. 10A, a blank pulse is a bias in which a cycle is iterated, the cycle being the entire interval made up of an interval (oscillation period A) over which an oscillating voltage and a DC voltage are superimposed and applied and a subsequent interval (oscillation-stopped period B) over which oscillation of the voltage is stopped and only a DC voltage is applied so that the voltage is kept at a certain voltage value. In other words, the oscillating voltage superimposed on the DC voltage in the blank pulse has the oscillation period A and the oscillation-stopped period B.

Also, the oscillating voltage is set to have a waveform of the equal magnitude of H1:H2=5:5. With this setting, an electrostatic latent image is developed into a toner image. In the present exemplary embodiment, during normal image formation which is the first mode, an exposed portion which is a bright portion (portion irradiated with a laser beam) on the photoconductor drum 1 is attached with toner and the electrostatic latent image is reversely developed. In the case where a blank pulse is applied as the developing bias, during the oscillation period A illustrated in FIG. 10A, when the magnitude of the oscillating voltage is on the H2 side, the influence of the electric field based on a potential difference between the surface potential of the developing sleeve (voltage value of the developing bias) and the surface potential of the photoconductor that opposes the developing sleeve at that time causes the toner on the surface of the developing sleeve to fly from the surface of the developing sleeve onto the surface of the photoconductor; when the magnitude of the oscillating voltage is on the H1 side, the toner attached on the photoconductor is brought back to the developing sleeve side conversely. The oscillation period A ends when the voltage is on the H2 side on which the toner is caused to fly onto the photoconductor side, and the oscillation-stopped period B starts. Because the oscillation period A ends when the voltage is on the H2 side, the oscillation-stopped period B starts in a state where the toner has flown to the photoconductor. During the oscillation-stopped period B, application of the oscillating voltage is stopped and the value of the DC voltage is maintained, whereby an amount of attached toner is adjusted such that density on the surface of the photoconductor to be developed becomes a density based on contrast. The above-described oscillation period A and oscillation-stopped period B are alternately iterated, whereby development in which density based on contrast is highly accurately realized can be performed. In the present exemplary embodiment, a potential VL of the bright portion which is a region in which a toner image on the surface of the photoconductor is formed during normal image formation which is the first mode is −300 V and the DC voltage component Vdc of the developing bias is −550 V. Therefore, a developing contrast Vcon during normal image formation, which is a potential difference between the DC voltage value Vdc of the developing bias and VL of a region in which the toner image on the surface of the photoconductor is formed during normal image formation, is such that Vcon=VL−Vdc=250V.

Also, a high-voltage waveform circuit capable of applying, as the developing bias, waveforms illustrated in FIGS. 10B and 10C as well as the blank pulse was used. FIG. 10B is referred to as a rectangular bias because it does not include a blank, while FIG. 10A is referred to as a blank pulse. The rectangular bias is a bias which does not include an oscillation-stopped period unlike the blank pulse and in which an interval (corresponding to the oscillation period A of FIG. 10A) over which an oscillating voltage and a DC voltage are superimposed and applied is iterated. As in FIG. 10A, the oscillating voltage is set to have a waveform of the equal magnitude of H1:H2=5:5.

FIG. 10C shows a rectangular bias like FIG. 10B; however, the magnitude of the AC voltage is set to be H3:H4=6:4 to make the duty period of the H4 side larger than that of the H3 side. H3 represents a voltage direction for a toner developing side (side on which toner is caused to fly onto the photoconductor), and the voltage value in the toner developing direction is larger than that of the waveform of FIG. 10B, which thus makes it easier to perform development with toner. Because the magnitude of AC voltage is unbalanced, this is referred to as an unbalanced rectangular bias. FIGS. 10B and 10C are used in the analog image output mode which is the second mode described later.

At this time, an amount of charge of the toner developed on the photoconductor drum 1 is −25 μC/g.

The thin layer of the developing agent on the developing sleeve 4*b* that has passed the development portion c is returned to a development-agent storage within the developing container 4*a* as the developing sleeve 4*b* further rotates.

In order to keep toner density of the two-component developing agent 4*e* contained in the developing container 4*a* within a predetermined substantially constant range, the toner density of the two-component developing agent 4*e* contained in the developing container 4*a* is detected by an optical toner density sensor (not illustrated), for example. Then, in accordance with the detected information, the toner hopper 4*g* is controlled to be driven and the toner contained in the toner hopper is added to the two-component developing agent 4*e* contained in the developing container 4*a*. The toner added to the two-component developing agent 4*e* is stirred by the stirring members 4*f*.

[5] Transfer Means, Fixing Means

In the present embodiment, the transfer roller 5 (transfer device) is used as a transfer means. This transfer roller 5 is pressed against the surface of the photoconductor drum 1 by a predetermined pressing force, and this pressed nip portion serves as a transfer portion d. The recording medium P (e.g., paper or transparent film) is fed to this transfer portion d from a feeder mechanism portion (not illustrated) at a predetermined control timing.

The recording medium P fed to the transfer portion d is sandwiched and transported between the rotating photoconductor drum 1 and the transfer roller 5. During this period, a positive transfer bias (+2 kV in the present embodiment) which has a polarity opposite to the negative polarity which is the normal charge polarity of the toner is applied to the transfer roller 5 by a transfer-bias application power source S3. In this way, the toner image on the photoconductor drum 1 is sequentially electrostatically transferred onto the surface of the recording medium P.

The recording medium P that has passed the transfer portion d and on which the toner image has been transferred is sequentially separated from the surface of the photoconductor drum 1 and is transported to the fixing device 6 which serves as a fixing means, at which the recording medium P is heated and pressed by a fixing roller 6*a* and a pressure roller 6*b* and the toner image is fixed on the surface. Then, the recording medium P is output as a product of image formation (printing, copying).

[6] Charger Tilt Adjusting Means

Figure 3:
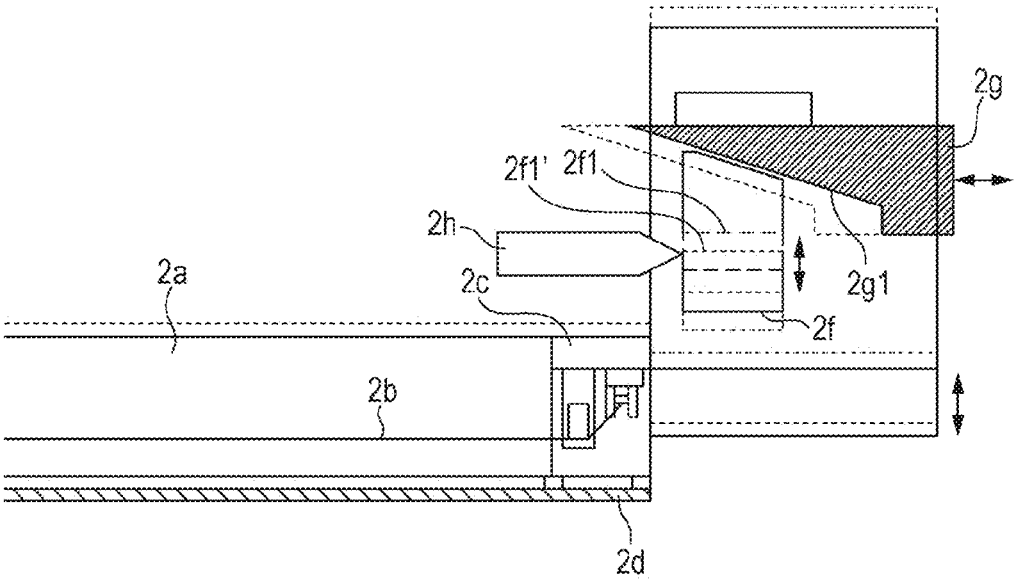
FIG. 3 is a sectional view schematically illustrating a structure around a tilt adjusting means of a corona charger.

FIG. 3 is a sectional view schematically illustrating a structure around the tilt adjusting means of the above-described corona charger 2.

In this figure, 2*a* represents the shield made of a conductive member, such as metal; 2*b* represents the wire serving as the discharge electrode; and 2*c* represents an end block for fixing a front end of the wire (end on the proximal side of the image forming apparatus); 2*d* represents the grid electrode; 2*f* represents a slider for changing a distance of the front end of the grid 2*d* from the surface of the photoconductor drum 1; and 2*g* represents a pressing member in which a tapered portion 2*g*1 is formed at its lower side. 2*g* is provided at the upper end of the slider 2*f* to be movable in a back-and-forth direction (the proximal side to the distal side of the apparatus) as indicated by arrow in the figure. Also, the pressing member 2*g* is configured to be moved by a screw not illustrated.

By moving the pressing member 2*g* back and forth, the slider 2*f* relatively moves along the tapered portion 2*g*1 and the slider 2*f* consequently moves up and down. 2*h* represents a charger positioning member provided in the body of the image forming apparatus. The distance of the front end of the grid electrode 2*d* from the surface of the photoconductor drum 1 is decided as a result of 2*h* being inserted into a positioning hole 2*f*1 of the slider 2*f*. The above-described 2*g*, 2*f*, and 2*h* serve as an adjusting means for adjusting the distance between the grid electrode 2*d* of the corona charger 2 and the surface of the photoconductor drum 1.

Although not illustrated, the slider 2*f* for changing the distance from the surface of the photoconductor drum 1 is not provided at the rear end of the grid electrode 2*d*. Thus, the distance between the rear end of the grid electrode 2*d* and the photoconductor drum 1 is fixed.

The shield case 2*a* is provided such that its openings oppose the photoconductor drum 1, and is provided to be substantially in parallel with a rotation axis of the photoconductor drum 1 with a predetermined gap therebetween. By moving the slider 2*f* up and down, the front end of the grid electrode 2*d* becomes close to or far from the surface of the photoconductor drum 1 and a tilt angle of the grid electrode 2*d* on a perpendicular plane relative to the direction of the rotation axis of the surface of the photoconductor drum 2*d* changes. As is known, when the grid electrode 2*d* is brought closer to the photoconductor drum 1, the charge potential of the photoconductor drum 1 becomes a value closer to the value of the DC voltage applied to the grid electrode 2*d*, and the absolute value thereof increases. Accordingly, as a result of changing the tilt angle of the grid 2*d*, the charge potential of the photoconductor drum 1 changes with inclination in the axis direction. With this configuration, the potential in the main-scanning direction at the development position of the photoconductor drum 1 can be adjusted to be even, by checking an adjustment toner image used to adjust a tilt of the corona charger 2 which is output in the analog image output mode which is the second mode described later and by adjusting the tilt of the corona charger 2 relative to the surface of the photoconductor drum 1 in the longitudinal direction of the corona charger 2.

[Analog Image Output Mode]

The analog image output mode which is the second mode in the present exemplary embodiment will be described.

In the analog image output mode, the surface of the photoconductor drum 1 is charged by the corona charger. Then, a toner image is formed on the surface of the photoconductor drum 1 by the developing device 4 which serves as the developing means, substantially without exposure performed by the exposure device 3 which serves as the exposure means. Then, the toner image is transferred onto a recording medium by the transfer device, and is output, via the fixing device 6, as an adjustment toner image used to adjust a tilt of the corona charger 2 relative to the surface of the photoconductor drum 1 in the longitudinal direction of the corona charger 2.

As described later, in this analog image output mode, the control means 7 which serves as the execution means adjusts at least one of a DC voltage of the charging bias applied to the grid electrode and a DC voltage of the developing bias to be a bias of a predetermined DC voltage value so as to make analog-image-output-mode developing contrast Vcont, which is a potential difference between the value of the DC voltage of the developing bias and the dark portion potential VD which is a potential at a region in which the toner image on the photoconductor is formed, becomes smaller than developing contrast Vcnt of normal image formation which is the first mode. In this way, an adjustment toner image used to adjust a tilt of the charger is formed on the photoconductor drum 1 (analog development). Then, this adjustment toner image is transferred onto a recording medium and is automatically output. A density difference in the main-scanning direction (direction of the rotation axis of the photoconductor drum 1) of the toner image on the recording medium output in this mode (hereinafter, referred to as an analog image) is visually checked by a service person. The density difference is checked by checking at least densities at the respective ends of the analog image in the main-scanning direction and comparing the densities at the respective ends with each other. Based on the check result, an inclination of the charge potential with respect to the direction of the rotation axis of the photoconductor drum 1 can be adjusted by the above-described charger tilt adjusting means. Here, the tilt angle of the grid electrode which serves as a grid of the charging device 2 on a perpendicular plane relative to the main-scanning direction of the surface of the photoconductor drum 1 is made changeable. By adjusting the above-described tilt angle of the grid electrode relative to the main-scanning direction of the surface of the photoconductor drum 1 (tilt angle of the corona charger 2 relative to the surface of the photoconductor drum 1 in the longitudinal direction of the corona charger 2), an inclination in charge potential with respect to the direction of the rotation axis of the photoconductor drum 1 can be adjusted. For example, in the present exemplary embodiment, as the distance between the grid and the surface of the photoconductor drum 1 increases, the absolute value of the surface potential of the photoconductor drum 1 decreases. Thus, the developing contrast Vcont increases in the positive direction, and density of the analog image changes toward a density increasing direction. As the distance between the grid and the surface of the photoconductor drum 1 decreases, the absolute value of the surface potential of the photoconductor drum 1 increases. Thus, the developing contrast Vcont increases toward the negative direction, and density of the analog image changes toward the density decreasing direction.

Figure 8:
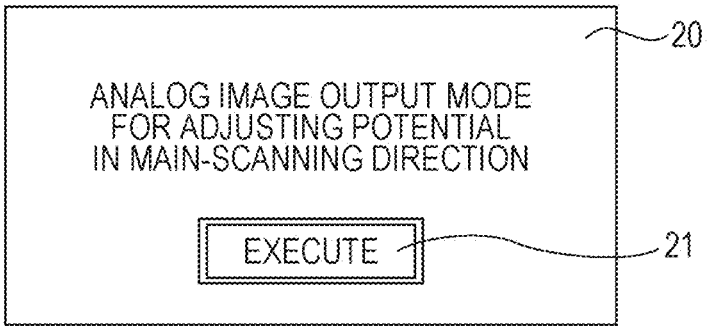
FIG. 8 is a diagram illustrating an example of an execute button which is displayed on a touchscreen in order to execute an analog image output mode according to the present exemplary embodiment.

Herein, as an instruction means (input means) for giving an instruction to start execution of the analog image output mode, an execute button 21 is provided on a touchscreen 20 which serves as an operation unit provided in the body as illustrated in FIG. 8. The analog image can be automatically output by pressing this execute button 21. The control means 7 which serves as the execution means includes a memory means in which image formation conditions for outputting the analog image are preset (pre-stored), and the adjustment toner image used to adjust a tilt of the corona charger is automatically output by pressing this execute button 21.

Now, the analog image output mode will be described in detail by using a figure.

Figure 4:
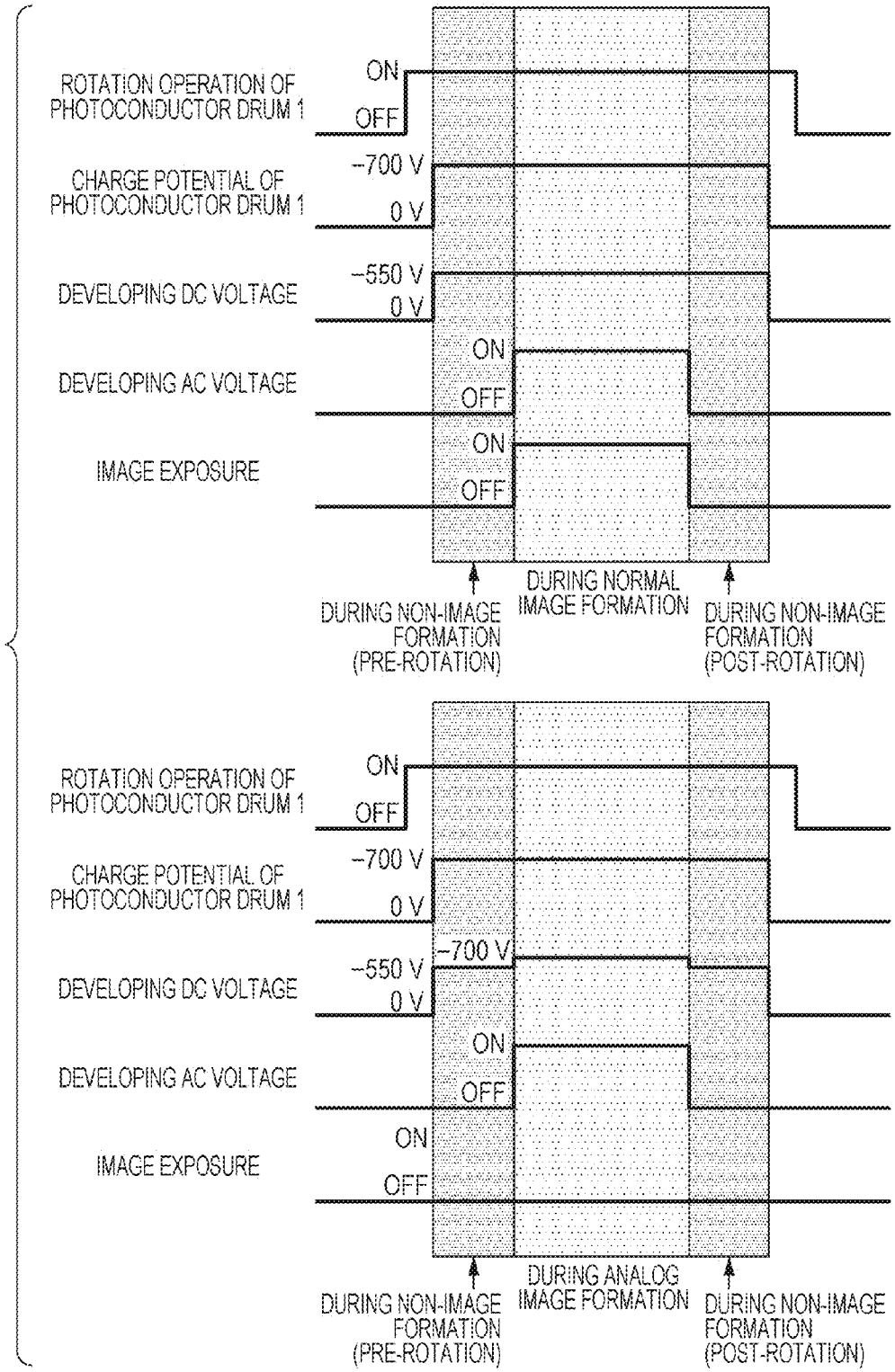
FIG. 4 is a diagram illustrating absolute values and application timings of voltages applied during normal image formation and during analog image formation.

FIG. 4 illustrates absolute values and application timings of voltages applied during normal image formation which is the first mode and during analog image formation which is the second mode in accordance with the present embodiment. Here, normal image formation used in the present exemplary embodiment indicates that an electrostatic latent image is formed through exposure performed by the exposure means on the charged surface of the photoconductor drum 1 in accordance with an image forming signal which is information of an image to be formed and this electrostatic latent image latent image (bright portion) is developed with toner to form the image.

Also, analog image formation in the analog image output mode indicates that development is performed with toner at the charge potential (potential of a dark portion) without forming an electrostatic latent image through exposure performed by the exposure means. The analog image of the present exemplary embodiment is set such that the adjustment toner image is developed in a non-image region which is supposed not to be developed, by making the developing contrast which is a potential difference between the charge potential VD (potential of the dark portion) of the photoconductor drum 1 and the DC voltage value Vdc of the developing bias, smaller than that of normal image formation (that is, so-called fog is forcibly caused). Alternatively, the analog image can be formed by making the absolute value of the DC component of the developing bias larger than the absolute value of the charge potential.

Herein, during normal image formation, the charge potential VD is set to −700 V, the DC voltage component Vdc of the developing bias is set to −550 V, and the oscillating voltage component of the developing bias is set to have a blank pulse waveform. Accordingly, in the case where the potential VL of the exposed portion (potential of a bright portion) is −300 V, the developing contrast Vcnt is 250 V. On the other hand, during analog image formation, the DC voltage component Vdc of the developing bias is changed to −700 V and the oscillating voltage component is set to be a rectangular bias. Accordingly, the developing contrast Vcnt of this case is 0 V. Note that the charge potential VD of the photoconductor drum 1 used herein is a value measured by the potential measuring device 10 located at the center in the main-scanning direction of the photoconductor drum 1. The DC component Vdc of the developing bias is set relative to the charge potential VD of the photoconductor measured at the position of the potential measuring device 10.

In order to increase accuracy in adjustment of a tilt of the charger, an amount of change in density of the output image relative to an amount of change in the potential difference Vcont between the charge potential VD of the photoconductor drum 1 and the DC voltage component of the developing bias in the analog image output mode is preferably large.

The change in density relative to the change in contrast when an analog image is output may vary depending on the state of the developing agent. In general, the change in density relative to the change in contrast is smaller for a new developing agent and is larger for developing agent that has deteriorated. For this reason, even if a tilt of the charger is adjusted using a new developing agent, when the developing agent has deteriorated, a slight contrast may result in a density difference, unevenness in potential charged may result in unevenness in density, and the resulting image may become a defective image. In such a case, a tilt of the corona charger may need to be adjusted again when the developing agent has deteriorated.

Figure 12:
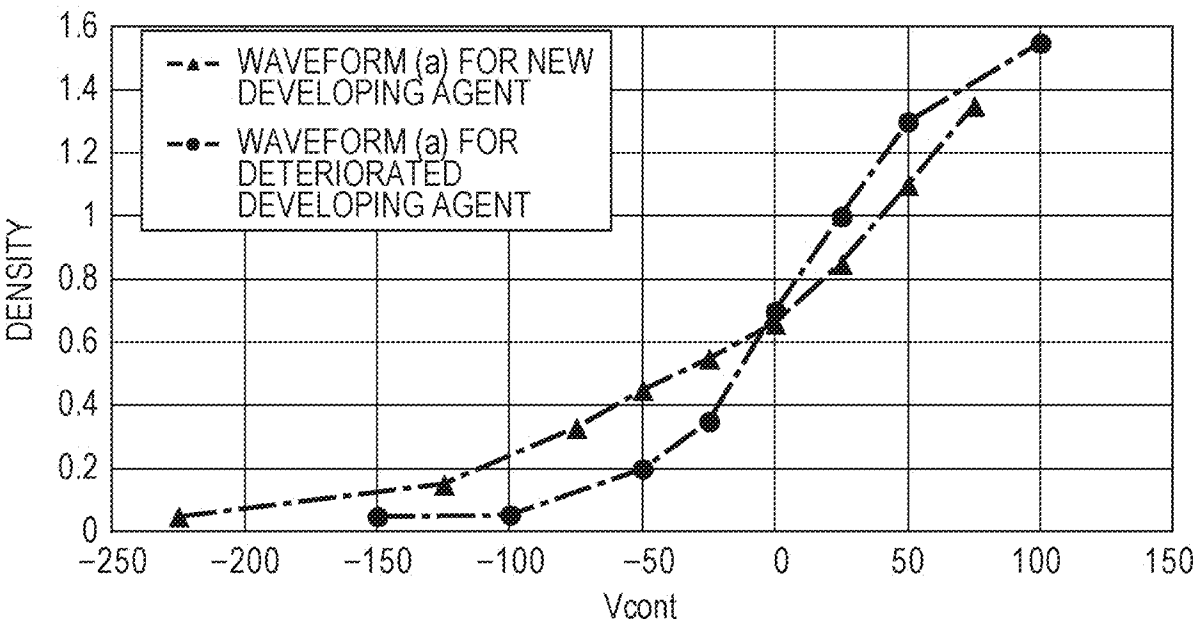
FIG. 12 is a graph showing a relationship among a state of a developing agent, developing contrast, and density of a toner image.

How much density changes against a change in contrast which is a potential difference between the dark portion potential of the photoconductor drum 1 and the DC voltage of the developing bias when an analog image is output was actually comparatively investigated by using a new developing agent and a deteriorated developing agent. FIG. 12 is a graph showing characteristics of a change in density against a change in contrast in the case where an analog image is output when the developing agent is new and when the developing agent has deteriorated. In this investigation, a blank pulse is used as the oscillating voltage superimposed in the developing bias. FIG. 12 indicates that a change in density per unit contrast (i.e., inclination) is larger for the deteriorated developing agent than for the new developing agent within a density range of 0.4 to 0.8. Specifically, within the density range of 0.4 to 0.8, a ratio of density change per contrast of 1 V is 0.0050 (density/V) for the new developing agent and is 0.0130 (density/V) for the deteriorated developing agent. This also indicates that, because the ratio of density change per contrast of 1 V for the deteriorated developing agent is more than twice as large as that for the new developing agent, unevenness in potential (difference in contrast) is more likely to appear as unevenness in density. In the case where a blank pulse is used as the oscillating voltage superimposed in the developing bias in the analog image output mode, it is difficult to recognize, at a stage of using the new developing agent, unevenness in potential due to a tilt of the charger which appears significantly as unevenness in density when the deteriorated developing agent is used.

Figure 11:
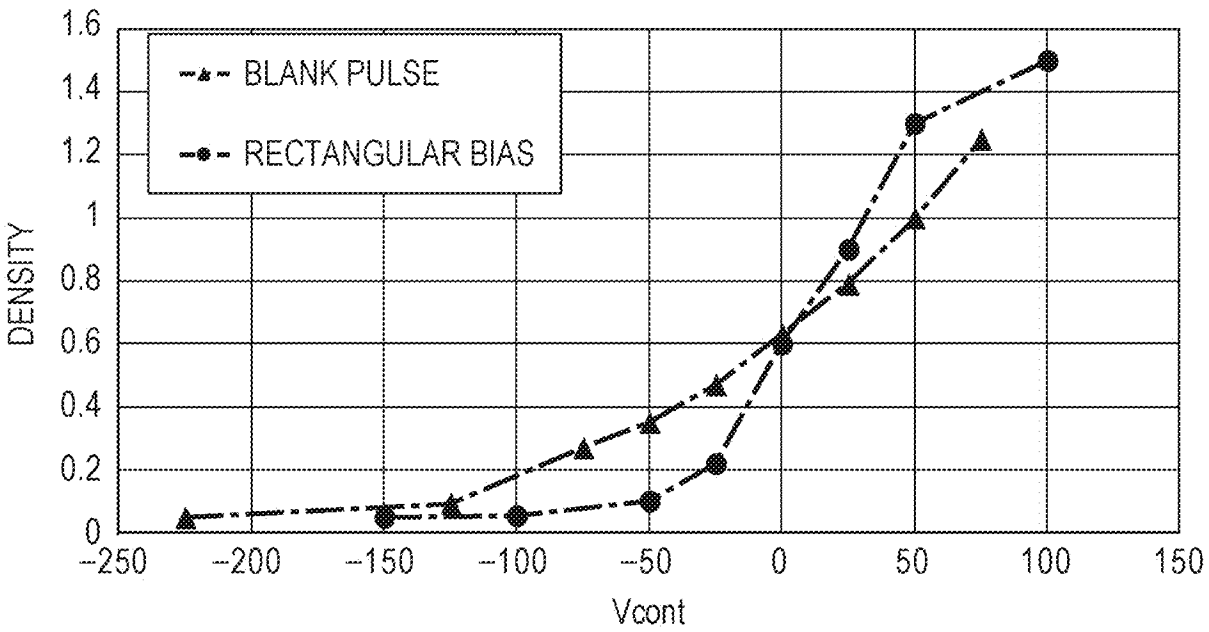
FIG. 11 is a graph showing a relationship between developing contrast and density of a toner image for different developing bias waveforms.

Accordingly, it was found that an amount of change in density of a toner image relative to an amount of change in developing contrast is larger when the rectangular bias illustrated in FIG. 10B which does not include an oscillation-stopped period is used as the oscillating voltage superimposed in the developing bias used in the analog image output mode instead of a blank pulse used during normal image formation, than that of the case where analog image formation is performed by superimposing a blank pulse in the developing bias as the oscillating voltage. FIG. 11 is a graph showing characteristics of a change in density of a toner image against a change in developing contrast Vcnt when an analog image is output in the cases where the blank pulse (FIG. 10A) used during normal image formation and the rectangular bias (FIG. 10B) are employed as the oscillating voltage superimposed in the developing bias used in the analog image output mode. Note that the developing contrast Vcnt of this case is a potential difference between the DC voltage value Vdc of the developing bias and the dark portion potential VD which is a potential of a region in which the toner image on the photoconductor drum 1 is formed, and is expressed by Equation of Vcnt=VD−Vdc in the present exemplary embodiment.

FIG. 11 indicates that, within a density range of 0.4 to 0.8, a change in density per unit contrast (i.e., inclination) is larger in the case where the rectangular bias is used than in the case where the blank pulse is used. Specifically, within the density range of 0.4 to 0.8 (larger than or equal to 0.4 and smaller than or equal to 0.8), a change in density per contrast of 1 V is 0.0053 (density/V) for the blank pulse and is 0.0140 (density/V) for the rectangular bias. This also indicates that a change in density per contrast of 1V in the case where the rectangular bias is employed as the oscillating voltage superimposed in the developing bias is more than twice as large as that of the case where the blank pulse used during normal image formation is employed, and unevenness in potential is more likely to be recognized.

An exact reason why a change in density per contrast of 1 V during analog image formation increases by using, as the oscillating voltage superimposed in the developing bias, the rectangular bias instead of the blank pulse that is used during normal image formation is unknown; however, because the rectangular pulse which does not include oscillation-stopped periods has a larger number of pulses (higher frequency) per unit time than the blank pulse which includes oscillation-stopped periods, the influence when the waveform of the oscillating voltage is on the H2 side on which the toner on the developing sleeve receives a force to fly toward the photoconductor drum 1 and the influence when the waveform of the oscillating voltage is on the H1 side on which the toner receives a force to return from the photoconductor drum 1 side increase. Here, the force received by the toner changes depending on a potential difference between the surface potential of the photoconductor drum 1 and the voltage value of the developing bias in which the oscillating voltage is superimposed. For example, in the case where the potential difference increases when the waveform of the oscillating voltage is on the H2 side, the force received by the toner in a direction in which the toner flies toward the photoconductor drum 1 increases, and a larger amount of toner attaches to the surface of the photoconductor drum 1. In such a case, because the potential difference between the surface potential of the photoconductor drum 1 and the voltage value of the developing bias in which the oscillating voltage is superimposed when the waveform of the oscillating voltage is on the H1 side decreases, the force for bringing the toner back to the photoconductor drum 1 side decreases, and an amount of toner that is brought back from the surface of the photoconductor drum 1 decreases. As the number of pulses increases, a difference between an amount of toner attached to the surface of the photoconductor drum 1 at H1 and H2 and an amount of toner that is brought back from the surface of the photoconductor drum 1 increases. As a result, it is estimated that a change in density relative to a change in contrast increases.

The case where the rectangular bias is used as the oscillating voltage superimposed in the developing bias has been described. The unbalanced rectangular bias illustrated in FIG. 10C also has a larger number of pulses per unit time (higher frequency), and thus a change in density per contrast of 1 V becomes larger than that of the blank pulse and similar advantages are obtained.

In the present exemplary embodiment, an analog image was output using the rectangular bias as the oscillating voltage component superimposed in the developing bias and a tilt of the corona charger was adjusted in the above-described manner.

In the present embodiment, analog images whose toner images have densities of 0.5 to 0.6 (so-called, halftone densities) when measured by a reflection densitometer of X-Rite Inc. at the position of the potential measuring device 10 located at the center in the main-scanning direction (direction of the rotation axis) of the photoconductor drum 1 are output. Then, the tilt angle of the grid electrode 2*d* was adjusted so as to make a difference in density between the front end and the rear end of the images in the main-scanning direction becomes smaller than or equal to 0.02. As for analog images, it is sufficient that the image density at the position of the potential measuring device 10 located at the center in the main-scanning direction (direction of the rotation axis) of the photoconductor drum 1 is in a range that is larger than or equal to 0.4 and smaller than or equal to 0.8; however, it is more preferable that the image density be in a range that is larger than or equal to 0.5 and smaller than or equal to 0.6.

Note that the aforementioned density is a value obtained by measuring, with a reflection densitometer from X-Rite Inc., a density of an analog image output using, as the recording medium, high-quality white paper GFC081 from CANON KABUSHIKI KAISHA. The absolute value of density to be adjusted may be appropriately adjusted depending on a medium used for outputting and a reflection densitometer. The aforementioned halftone density may be defined by an amount of developing agent on the photoconductor drum. Suppose that the weight of developing agent per unit area on the photoconductor drum when so-called solid fill density is output is denoted as 100%. In this case, a density of 0.5 to 0.6 corresponds to a range in which the weight of developing agent per unit area on the photoconductor drum is 30 to 70%. The range of the weight of developing agent per unit area on the photoconductor drum broadens because a reflection density changes depending on a fixing temperature applied to the developing agent and the recording medium.

That is, as for a magnitude of the developing contrast used to adjust a tilt of the charger, in the case where the weight of developing agent per unit area on the photoconductor drum when solid fill density is output is denoted as 100%, the height of the charger can be adjusted most accurately if the weight of developing agent per unit area on the photoconductive drum is in a range of 30 to 70%. In the case where the weight of developing agent per unit area on the photoconductor drum when solid fill density is output is 100%, the tilt of the charger can be adjusted more accurately than that achieved by the related art if the weight of developing agent per unit area on the photoconductor drum is a halftone density in a range of 20 to 80%.

Table 1 shows an amount of change in density against a change of the developing contrast of 1 V (inclination of the density change against the contrast change) within a density range of 0.3 to 0.9 in the case where the frequency of the oscillating voltage (rectangular bias) superimposed in the developing bias in the analog image output mode is changed.

Table 1 indicates that as the frequency of the oscillating voltage increases, the amount of change in density per developing contrast of 1 V increases. However, Table 1 also indicates that the amount of change in density per developing contrast of 1 V in the case where the frequency of the oscillating voltage is increased to 17 kHz conversely becomes smaller than that of the case where the frequency of the oscillating voltage is set to 14 kHz. This indicates that the amount of change in density per developing contrast of 1 V increases as the frequency of the oscillating voltage increases; however, the amount of change in density per developing contrast of 1 V decreases in the case where the frequency is set larger than 14 kHz.

TABLE 1

| | Frequency of oscillating voltage | | | | |
|---|---|---|---|---|---|
| | 5 kHz | 8 kHz | 11 kHz | 14 kHz | 17 kHz |
| Density change per 1 V (density/V) | 0.00448 | 0.00452 | 0.005 | 0.00564 | 0.00492 |

Figure 9:
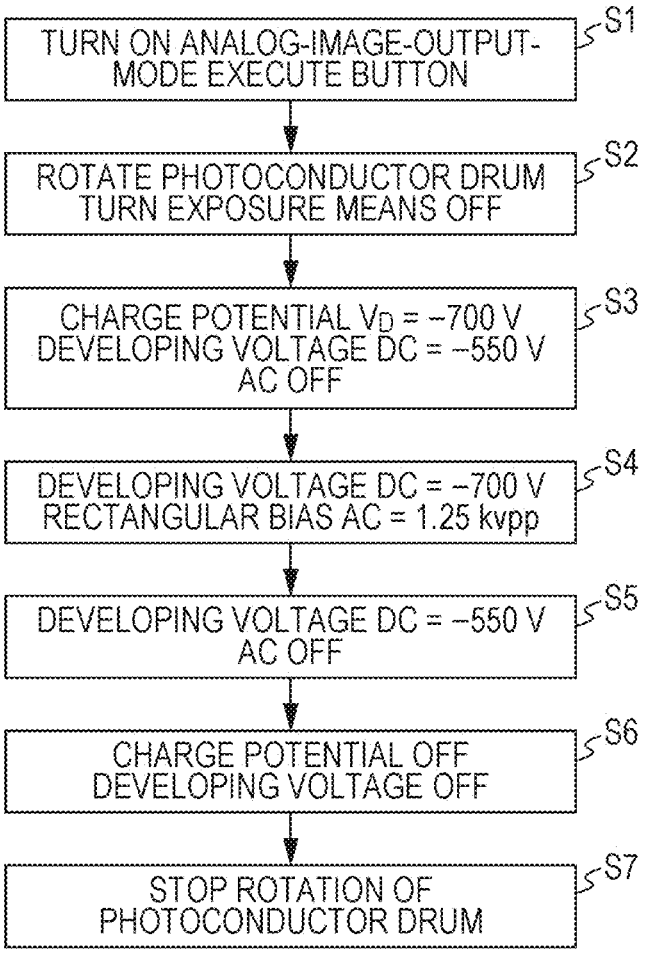
FIG. 9 is a flowchart of the analog image output mode according to the present exemplary embodiment.

FIG. 9 illustrates a flowchart of the analog image output mode according to the present exemplary embodiment.

When the execute button 21 which serves as the instruction means for giving an instruction to start execution of the analog image output mode is pressed by an operator (S1), the control means 7 which serves as the execution means rotates the photoconductor drum 1 while keeping the exposure means in an off state. (S2) Then, the control unit 7 causes a preset charging bias to be applied to the corona charger so as to make the photoconductor drum 1 have a potential of −700 V, causes a developing bias (the DC voltage=−550 V, the oscillating voltage off) to be applied to the developing sleeve, and executes a pre-rotation. (S3) In S3, in the present exemplary embodiment, the control means 7 performs constant current control to make the value of current that flows through the corona discharge electrode equal to −1000 μA and controls the DC voltage applied to the grid to set a predetermined charge potential so that the charge potential of the photoconductor drum 1 becomes −700 V during image formation.

Then, the developing bias applied to the developing sleeve is changed to (the DC voltage=−700 V, the oscillating voltage=1.25 kVpp, the rectangular bias) at a certain timing, and an adjustment toner image is formed on the photoconductor drum 1 through analog development. (S5). An analog image thus developed is transferred onto a transported recording medium, and is output as an adjustment analog image used to adjust a tilt of the corona charger. As described above, in the present exemplary embodiment, a not-exposed portion can be developed with toner by making a difference between the charge potential of the photoconductor drum 1 and the DC voltage value of the developing bias smaller than that of normal image formation.

After development of the adjustment toner image used to adjust a tilt of the corona charger has been finished, the control means 7 returns the developing bias to (the DC voltage=−550 V, the oscillating voltage off), and performs post-rotation. (S6) Then, the control means 7 turns off outputting of the charging bias and the developing bias, and (S7) stops rotation of the photoconductor drum 1. (S7)

As described above, because the image forming apparatus has a mode in which an adjustment toner image used to adjust a tilt of the corona charger is output, an analog image used to adjust a tilt of the corona charger can be easily output without any complicated settings.

In the present exemplary embodiment, analog development of toner is performed in a not-exposed portion which is a dark portion by making the DC voltage of the developing bias different from that used during normal image formation and keeping the exposure means in the off state; however, the configuration is not limited to this one. Specifically, instead of changing the DC voltage value of the developing bias, the charge potential of the surface of the photoconductor drum 1 may be changed while keeping the exposure means in the off state, or both the developing DC voltage and the charge potential may be adjusted. In the case where the charge potential is changed, the charge potential may be set by adjusting the DC voltage applied to the grid electrode.

Also, in the present exemplary embodiment, the developing contrast which is a potential difference between the charge potential (DC voltage of the charging bias) of the photoconductor drum 1 and the DC voltage of the developing bias is made smaller during analog image formation than that of normal image formation; however, the configuration is not limited to this one as long as a relationship allows toner to be developed in the not-exposed portion which is a dark portion. For example, the absolute value of the DC voltage of the developing bias may be made larger than the absolute value of the charge potential or of the DC voltage of the charging bias.

According to the present exemplary embodiment, an adjustment toner image used to adjust a tilt of the corona charger, in which a change in surface potential of the photoconductor is emphasized as a change in density, can be formed, and a slight change in surface potential of the photoconductor can be visually recognized as a change in density of the toner image.

[In the Case of Including Plurality of Image Forming Units]

Figure 5:
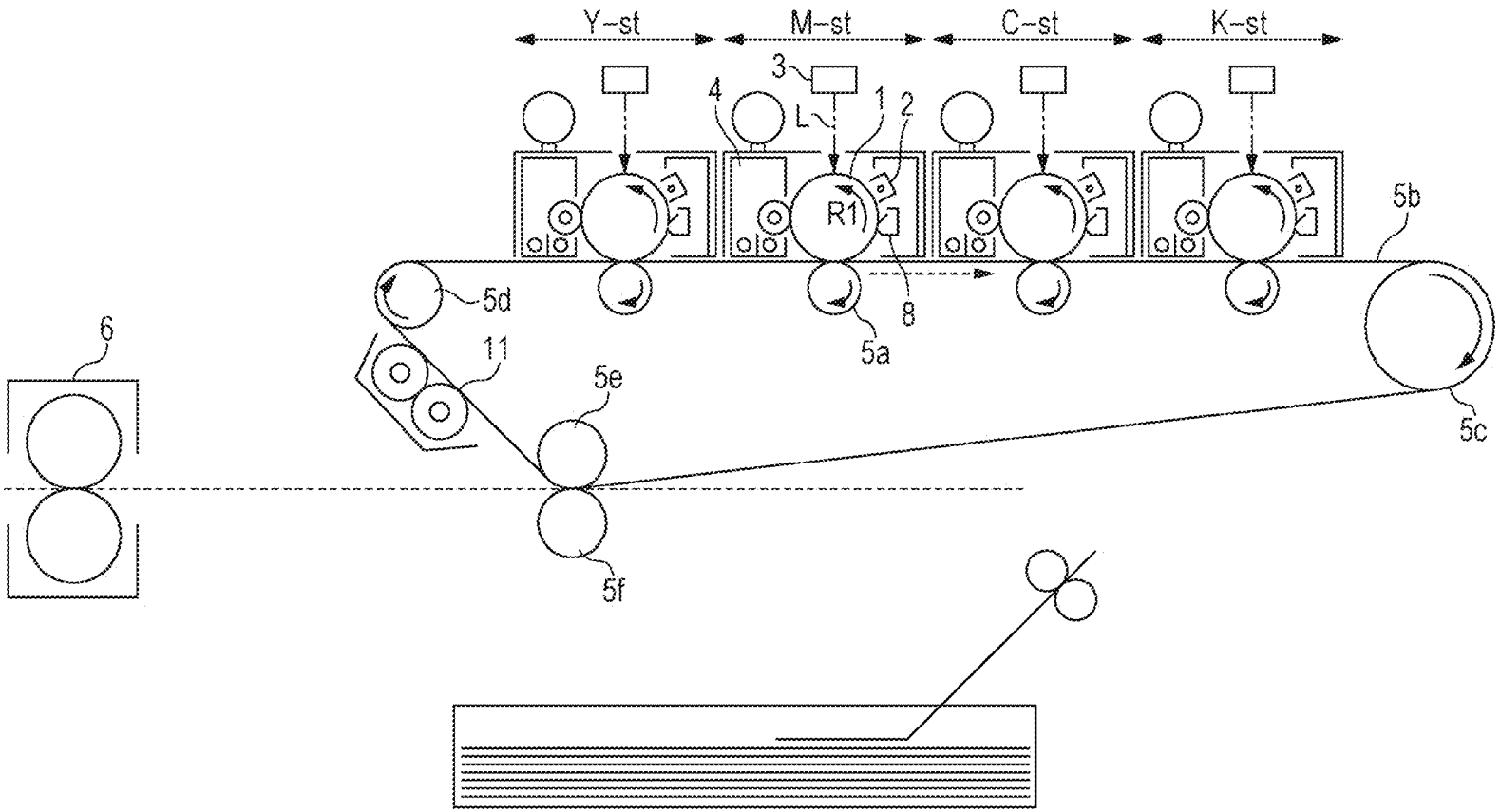
FIG. 5 is a configuration diagram schematically illustrating an image forming apparatus that includes a plurality of image forming units according to the present exemplary embodiment.

FIG. 5 is a schematic diagram of a general configuration of an example of an image forming apparatus including a plurality of image forming units.

The image forming apparatus (printer) of FIG. 5 has a configuration similar to that of the image forming apparatus of FIG. 1 unless otherwise noted. Specifically, the image forming apparatus includes image forming means (image forming units) each including a photoconductor drum 1, and, sequentially along the rotation direction thereof (direction of arrow R1), a corona charger 2, an exposure device (exposure means) 3, a developing device (developing means) 4, a transfer means 5, a potential measuring device 10 not illustrated, and a discharging device 9 not illustrated. A difference from FIG. 1 is that a plurality of (four) image forming units are provided in tandem. The respective image forming means form yellow, magenta, cyan, and black toner images.

Also, unlike the one in FIG. 1, the transfer means 5 employs an intermediate transfer body method in the present embodiment. 5*b* represents an intermediate transfer belt whose resistance is adjusted by distributing carbon on a resin such as polyethylene terephthalate or polyimide. 5*c* represents a driving roller, and rotationally drives the intermediate transfer belt 5*b*. The driving roller 5*c* rotates in a direction to rotationally drive the transfer belt 5*b* so that the transfer belt 5 moves in the same direction as the direction in which the photoconductor drum 1 moves. 5*d* represents a tension roller, and is adjusted to keep the intermediate transfer belt 5 at a certain tension between the driving roller 5*c* and an opposing roller 5*e*. 5*a* represents a primary transfer roller, and is arranged to oppose the photoconductor drum 1 of each image forming means with the transfer belt 5*b* interposed therebetween. 5*f* represents a secondary transfer roller, and collectively transfers toner images formed on the intermediate transfer belt 5*b* onto a medium. 11 represents an intermediate-transfer-belt cleaner, and prevents the intermediate transfer belt 5*b* from becoming dirty due to toner, paper dust, or the like.

In the image forming apparatus based on the intermediate transfer method, toner images created by the respective image forming means on the intermediate transfer belt 5*b* are transferred in the order of yellow, magenta, cyan, and black. Then, a toner image in which images of four colors are stacked each other is collectively transferred by the secondary transfer roller 5*f* onto a recording medium that has been fed to the secondary transfer roller 5*f* by a feeder means. Thereafter, the toner image on the recording medium is fixed by the fixing means 6.

The image forming apparatus of FIG. 5 has a mode (hereinafter, referred to as a four-color analog image output mode) in which an analog image is formed within one printed image without overlapping of the respective colors and is fixed on a medium which is 19-inch long and 13-inch wide.

Herein, the touchscreen 20 of FIG. 8 and the control unit 7 which serves as the execution means are included as the instruction means for giving an instruction to start execution of the four-color analog image output mode. By pressing the execute button 21 on the touchscreen illustrated in FIG. 8, a four-color analog image can be automatically output.

Figure 6:
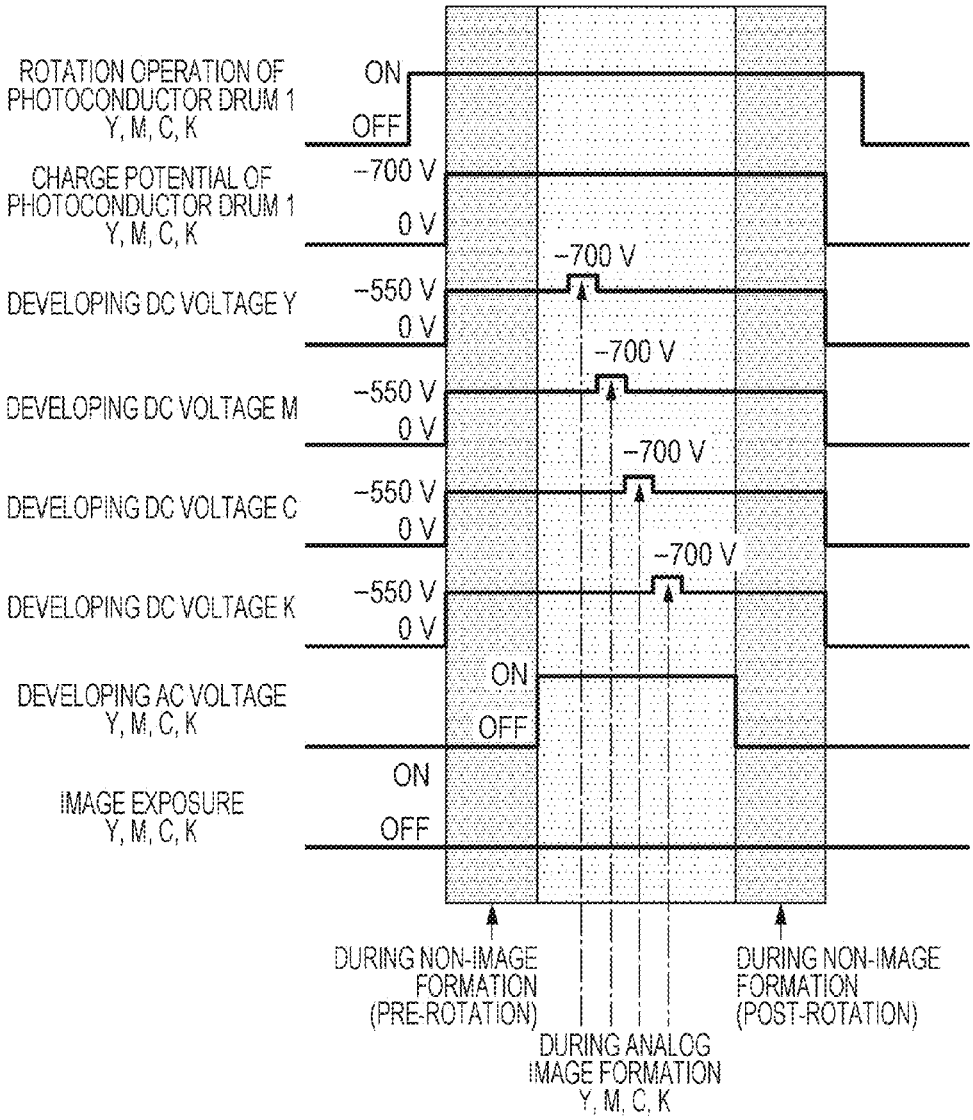
FIG. 6 is a diagram illustrating absolute values and application timings of voltages applied during a four-color analog image output mode according to the present exemplary embodiment.

FIG. 6 illustrates absolute values and application timings of voltages applied in the four-color analog image output mode. An application period of a DC voltage (−700 V herein) and an oscillating voltage (1.25 kVpp, rectangular bias) of the developing bias with which analog images of the respective colors are formed is set to 250 msec, and application timings for the respective colors are shifted from one another. With this configuration, as illustrated in FIG. 7, analog images of the respective colors having a width of 75 mm in the sub-scanning direction are formed within one printed image sequentially from the yellow station located upstream.

Figure 7:
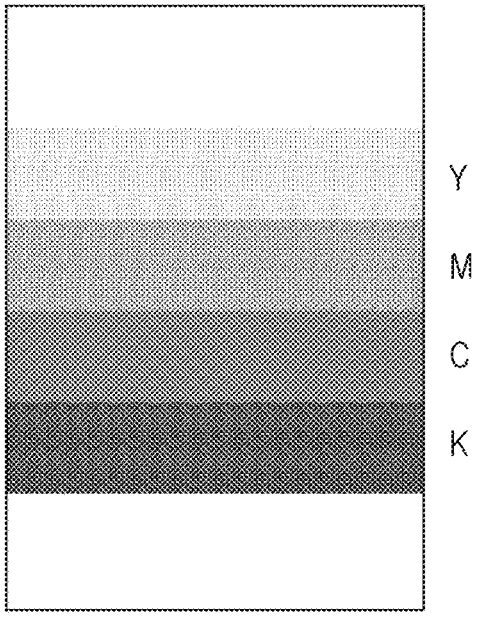
FIG. 7 is a diagram illustrating a state in which analog images of respective colors are formed within one printed image according to the present exemplary embodiment.

As described above, analog images are formed within one printed image without overlapping of the colors as illustrated in FIG. 7. With this configuration, differences in density of the individual colors between the front end and the rear end in the main-scanning direction can be simultaneously measured from one printed image, and the tilt angles of the grids 2*d* for the respective colors can be simultaneously adjusted. Also, with this configuration, the number of printed sheets used for adjustment can be reduced and analog images of the respective colors can be output in a short period of time.

Unlike a digital image formed during normal image formation, an image region of the analog image in the main-scanning direction generally has a width of the coat region of the two-component development agent 4*e* that is adsorbed and held on the perimeter surface of the developing sleeve 4*b* in the longitudinal direction of the developing sleeve. Accordingly, if the analog image is transferred onto a recording medium that is narrower than the coat region, toner not transferred onto the recording medium and remaining on the respective ends of the transfer belt 5*b* may make the respective ends of the secondary transfer roller 5*f* and the intermediate-transfer-belt cleaner dirty. This can be a reason for causing image defects such as back surface staining on following images. The digital image of the present exemplary embodiment refers to an image in which the dark tone and the light tone of density is reproduced by modulating an area subjected to exposure by the exposure means.

In the present embodiment, the width of the coat region of the two-component developing agent 4*e* adsorbed and held on the perimeter surface of the developing sleeve 4*b* is 328 mm. The image defects are prevented by transferring the analog image onto a recording medium having a horizontal width of 13 inches (330.2 mm) which is wider than the width of the coat region. That is, during a mode in which the adjustment analog image is output, the control means 7 preferably selects paper having a size in the width direction perpendicular to the transportation direction of the recording medium to be output that is larger than the width of the coat region of the developing sleeve 4*b* and performs outputting.

Also, occurrence of image defects due to a recording medium selection mistake is suppressed by causing a recording medium wider than the width of the coat region of the two-component developing agent 4*e* adsorbed and held on the perimeter surface of the developing sleeve 4*b* to be automatically selected at a timing at which the four-color analog image mode is started. In the case where there is only a recording medium narrower than the width of the coat region of the two-component developing agent 4*e*, a warning may be output, or the analog image may be output on the narrow medium by necessity and a solution, such as idle rotation, for resolving staining at the respective ends of the secondary transfer roller 5*f* and the intermediate-transfer-belt cleaner may be provided.

In the present embodiment, four colors of YMCK are described by way of example of a plurality of different colors used in the four-color analog image output mode; however, the plurality of different colors are not limited to these ones and, in the case of using a spot color such as dark and light toner, an analog image of the dark and light toner may be output.

Also, to adjust a tilt of the corona charger relative to the surface of the photoconductor drum 1, the distance of the grid electrode from the surface of the photoconductor drum 1 in the direction of the rotation axis of the photoconductor drum 1 (tilt of the grid electrode) is adjusted; however, an item to be adjusted is not limited to this one. For example, the distance between the surface of the photoconductor drum 1 and the wire in the main-scanning direction of the photoconductor drum 1 may be adjusted.

In the present exemplary embodiment, also in the tandem-type image forming apparatus including a plurality of image forming units, a change in surface potential of the photoconductor drum 1 of each of the plurality of image forming units can be detected more accurately as a change in density of a toner image with one analog image output, and a tilt of the charger can be adjusted more accurately.

Second Exemplary Embodiment

In the first exemplary embodiment, the example of making the frequency of the oscillating voltage superimposed in the developing bias in the analog image output mode larger than that of the oscillating voltage superimposed in the developing bias during normal image formation has been described. Similar advantages can be obtained by making at least of one of frequency and peak-to-peak voltage larger than that of the oscillating voltage superimposed in the developing bias during normal image formation.

For example, in the case where the oscillating bias superimposed in the developing bias during normal image formation is a blank pulse having a peak-to-peak voltage of 1.25 Vpp, the frequency is increased by using a rectangular bias which is not a blank pulse and the peak-to-peak voltage of the rectangular bias is set to 1.5 Vpp in the analog image output mode. Also in such a case, advantages similar to those of the first exemplary embodiment can be obtained. Also, in the case where the oscillating bias superimposed in the developing bias during normal image formation is not a blank pulse but is a rectangular bias, the rectangular bias may be used as the oscillating voltage superimposed in the developing bias used in the analog image output mode and the peak-to-peak voltage Vpp may be made larger than that of the oscillating voltage used during normal image formation without changing the frequency of the oscillating voltage. Even in such a case, similar advantages can be obtained.

Also, a blank pulse may be used as the oscillating voltage in the analog image output mode. In this case, the number of oscillation over an oscillation period of the blank pulse employed as the oscillating voltage in the analog image output mode may be made larger than that of a blank pulse used during normal image formation, the frequency of the blank pulse which includes oscillation-stopped periods may be increased by shortening the oscillation-stopped periods, or the peak-to-peak voltage may be increased such that, for example, 1.25 Vpp during normal image being changed to 2.0 Vpp without changing the frequency of the blank pulse.

As described above, the oscillating voltage superimposed in the developing bias used during normal image formation is not limited to a blank pulse, and may be a rectangular bias, unbalanced rectangular bias, or sine wave not having oscillation-stopped periods. In such a case, advantages similar to those of the present exemplary embodiment can be obtained by applying an oscillating voltage, at least one of frequency or peak-to-peak voltage of which is made larger in the analog image formation mode than that of the oscillating voltage superimposed in the developing bias during normal image formation.

Note that "substantially without performing exposure with the exposure device 3" described in the first and second exemplary embodiments includes the case where a light source included in the exposure means is in a conductive state, i.e., a power-on state, and the light source is in a standby light emitting state in which the light source emits pale light. In this case, although the light source is in the standby light emitting state, unevenness in potential in the main-scanning direction given to the potential of the photoconductor drum is less than or equal to 7 V and there is no influence on adjustment of a tilt of the charger.

The present invention is not limited to the above-described embodiments, and various modifications and alterations can be made without departing from the spirit and scope of the present invention. Accordingly, the following claims are attached in order to clarify the scope of the present invention.

According to the present invention, a slight change in surface potential of a photoconductor can be visually recognized as a change in density of a toner image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2013/082665, filed Dec. 5, 2013, which is hereby incorporated by reference herein in its entirety.

The invention claimed is:

1. An image forming apparatus comprising:

a photoconductor;

a corona charger disposed to oppose a surface of the photoconductor and configured to charge the surface of the photoconductor;

an exposure unit configured to expose the surface of the photoconductor that is charged by the corona charger to exposure so as to form an electrostatic latent image on the surface of the photoconductor;

a developing unit configured to develop, with toner, the electrostatic latent image that is formed by the exposure unit so as to form a toner image on the surface of the photoconductor;

a developing bias application unit configured to apply a developing bias obtained by superimposing a DC voltage and an AC voltage to the developing unit;

a transfer unit configured to transfer the toner image that is formed on the photoconductor onto a recording medium; and an execution unit configured to execute a first mode and a second mode, the first mode being a mode in which an electrostatic latent image is formed by the exposure means on the surface of the photoconductor that is charged by the corona charger and a toner image that is formed on the surface of the photoconductor by the developing means is transferred onto a recording medium and is output, the second mode being a mode in which a toner image that is formed on the surface of the photoconductor by the developing unit substantially without forming, by the exposure unit, an electrostatic latent image on the surface of the photoconductor that is charged by the corona charger is transferred onto a recording medium and is output as a toner image, wherein the execution unit sets a frequency of an AC voltage of the developing bias in the second mode to a value larger than a frequency of an AC voltage of the developing bias in the first mode.

2. The image forming apparatus according to claim 1, wherein the AC voltage of the developing bias in the first mode alternately includes an AC period over which a voltage value alternates and an alternation-stopped period over which alternation of the voltage value is stopped and the voltage value is kept at a certain voltage value, and the AC voltage of the developing bias in the second mode does not include the alternation-stopped period.

3. The image forming apparatus according to claim 1, wherein each of the AC voltage of the developing bias in the first mode and the AC voltage of the developing bias in the second mode alternately includes an alternation period over which a voltage value alternates and an alternation-stopped period over which alternation of the voltage value is stopped and the voltage value is kept at a certain voltage value, and the alternation-stopped period of the AC voltage of the developing bias in the second mode is shorter than the alternation-stopped period of the AC voltage of the developing bias in the first mode.

4. An image forming apparatus comprising:

a photoconductor;

a corona charger disposed to oppose a surface of the photoconductor and configured to charge the surface of the photoconductor;

exposure unit configured to expose the surface of the photoconductor that is charged by the corona charger to exposure so as to form an electrostatic latent image on the surface of the photoconductor;

developing unit configured to develop, with toner, the electrostatic latent image that is formed by the exposure unit so as to form a toner image on the surface of the photoconductor;

developing bias application unit configured to apply a developing bias obtained by superimposing a DC voltage and an AC voltage to the developing unit;

transfer unit configured to transfer the toner image that is formed on the photoconductor onto a recording medium; and execution unit configured to execute a first mode and a second mode, the first mode being a mode in which an electrostatic latent image is formed by the exposure means on the surface of the photoconductor that is charged by the corona charger and a toner image that is formed on the surface of the photoconductor by the developing means is transferred onto a recording medium and is output, the second mode being a mode in which a toner image that is formed on the surface of the photoconductor by the developing unit substantially without forming, by the exposure unit, an electrostatic latent image on the surface of the photoconductor that is charged by the corona charger is transferred onto a recording medium and is output as a toner image, wherein the execution unit sets an amplitude of an AC voltage of the developing bias in the second mode to a value larger than an amplitude of an AC voltage of the developing bias in the first mode.

* * * * *